United States Patent [19]

Arn

[11] 4,051,665

[45] Oct. 4, 1977

[54] OPERATING SWITCH AND RETAINER FOR DIGITAL WATCH CASES

[75] Inventor: Robert M. Arn, Toronto, Canada

[73] Assignee: Hayden/Arn Productions Limited

[21] Appl. No.: 649,143

[22] Filed: Jan. 14, 1976

[51] Int. Cl.[2] ..... G04B 19/30

[52] U.S. Cl. ..... 58/50 R; 200/52 R; 200/159 R; 200/293; 58/23 BA; 58/23 R

[58] Field of Search ..... 58/23 R, 23 BA, 50 R, 58/85.5; 317/101 R, 101 B, 101 C; 200/159 R, 159 B, 83 N, 293, 264, 52 R; 320/2; 240/10.65

[56] References Cited

U.S. PATENT DOCUMENTS

| | | | |
|---|---|---|---|
| 2,762,907 | 9/1956 | Schwartz | 240/10.65 |
| 3,766,350 | 10/1973 | Van Dyk et al. | 200/159 R X |
| 3,846,971 | 11/1974 | Ho et al. | 58/23 R |
| 3,911,663 | 10/1975 | Kern et al. | 58/23 BA |

*Primary Examiner*—Ulysses Weldon
*Attorney, Agent, or Firm*—Donald E. Hewson

[57] ABSTRACT

Electronic digital watches may be placed in an electrically non-conductive watch case which may be molded or cast plastic, together with an electrically conductive retainer casing, and the other components usually found in such electronic digital watches including an operating and digital display module, at least one activator post and an activator switch element for each activator post. In one embodiment, the electrically conductive retainer casing retains the inner end of each activator post out of contact with its respective activator switch element, but is flexible so as to permit momentary contact of the post with the switch element when desired. In another embodiment, a tab formed in the retainer casing may be momentarily brought into contact with an activator switch element by pressure against the activator post, without the post itself being in the switch circuit. In a third embodiment, the retainer casing is an electrically conductive elastomeric shell, and the activator post deforms a portion of the side thereof into contact with the switch element. The battery or batteries within the electronic digital watch case are maintained in electrical contact with the operating and digital display module so as to assure continuous operation of the watch.

3 Claims, 9 Drawing Figures

OPERATING SWITCH AND RETAINER FOR DIGITAL WATCH CASES

FIELD OF THE INVENTION

This invention relates to electronic digital watches. More particularly, this invention relates to electronic digital watches which are contained or enclosed within electrically non-conductive watch cases; and the invention provides an electrically conductive retainer casing for such watches.

BACKGROUND OF THE INVENTION

Electronic digital watches are so called because they provide a digital read-out of time, and can be worn by the user on his wrist in the usual manner. Unlike conventional watches, however, electronic digital watches have substantially no moving parts, no clockwork assemblies and no crown and stem assemblies. An electronic digital watch may have no continuous read-out or display if it is of the light-emitting diode (LED) type; or it may if it is of the liquid crystal display (LCD) type. In any event, such a watch may provide an indication of the time, or of continuous running of time in seconds, or of date, upon actuation of one or more controls by the user.

Normally, the controls of an electronic digital watch comprise an activator post which extends out from the side of the watch case in which the outer components are enclosed, and a buttom may be affixed to the outer end of the activator post for ease of contact by a finger of the user. When the user wishes to refer to his electronic digital watch for a particular indication of time or date, the appropriate activator button or buttons are pressed the required number of times by the user, and the required output is digitally displayed. Obviously, when no particular digital display is required, the watch must be such that the activator posts are not in an actuated condition. For this reason, the activator posts of an electronic digital watch function essentially as a momentary make switch. Subsidiary electronic circuits are provided within the watch so that, upon actuation of an activator button, one of those circuits is energized and the appropriate read-out is displayed. One or a plurality (usually two) of energy cells or batteries are included in the watch case, and are retained in operating contact with the electronic module by suitable spring means. The subsidiary, read-out circuits, are activated by the operation of the appropriate activator button against a switch element contained within the watch case, so as to close the electric circuit from the battery, through the watch case, the activator post which contacts the switch element, and the switch element to the electronic module. The activator post is, accordingly, spring-loaded or otherwise spring mounted so that it can be operated only by exerting pressure against its outer end beyond a pre-determined pressure, so as to close the appropriate subsidiary circuit; and release of the pressure against the activator post and activator button is followed by a return of the activator post to its normal position out of contact with the activator switch element. Thus, a momentary make switch is provided for each activator button and activator post included in the electronic digital watch.

Because, in the past, the casings of the electronic digital watches have had to be electrically conductive in order to ensure that at least the subsidiary electrical circuits which are operable by the user upon activation of one of the activator buttons, such casings have been expensive to produce and have had limited styling possibilities.

The present invention, therefore, provides a means whereby quite inexpensive watch cases for electronic digital watches may be designed having any desired exterior styling characteristics or shape, provided only that the interior of the watch case is appropriately dimensioned so as to receive the essential elements of the watch. This may be accomplished by casting or molding the watch cases using a suitable plastic material. However, any such suitable plastics material is substantially electrically non-conductive, and the present invention provides a retainer casing to be included within the watch case so as to retain the batteries in operating position within the case, and also so as to retain the activator posts in the appropriate manner so that each may be operated as a momentary make switch in the usual manner.

This is accomplished by providing an electrically conductive retainer casing within the substantially electrically non-conductive watch case. In general terms, the electrically conductive retainer casing is one which has a substantially planar bottom, and is adapted to contact and to exert and maintain spring pressure against the battery or batteries which are placed on the underside of the electronic and digital display module. The retainer casing has at least a portion thereof which is upstanding from the bottom of the casing at its edge, and that portion is adapted to retain the inner end of the activator post with which it is associated in such a position that it is out of a co-operating position with respect to the activator switch element on the digital display module. Thus, the inner end of the activator post is kept out of a position which would result in a closing action of the switch element so as to cause a particular digital read-out as determined by actuation of the activator button and post. At least a pre-determined force must, therefore, be exerted axially along the activator post from the button or the outer end of the post; and it will be noted, therefore, that at least the portion of the retainer casing which is co-operating with the inner end of each activator post is such that it is flexible and has an elastic memory so as to be temporarily deformable. Thus, when at least the pre-determined force is exerted axially along the activator post, the inner end of the post acts against the elastic memory of the portion of the retainer casing so as to move into a co-operating position with respect to the activator switch element, thereby causing an electrical circuit to be formed at least from the battery to the activator switch element through the retainer casing. When the axial force on the activator post is released, the elastic memory of the retainer casing portion causes the activator post to move out of the co-operating position with respect to the activator switch element.

Where the electrically conductive retainer casing is metallic or a metal coated plastic material, it may have at least one tab upstanding substantially perpendicularly from the bottom thereof and at the edge thereof, and being formed in a manner so as to retain the inner end of the activator post out of contact with its respective activator switch element. Thus, the retainer tab is flexible but requires a pre-determined pressure against the outer end of the activator post and axially therealong so as to cause the tab to temporarily deform sufficiently that the electrical circuit may be constituted, either through the end of the activator post or by the tab itself.

Upwardly extending spring tabs may be formed in the bottom of the retainer casing, and are adapted to contact and maintain spring pressure against the battery so as to maintain it in electrical contact with the electronic module.

In the preferred embodiments of such a retainer casing, as discussed hereafter, a plurality of tabs is formed at the edge of the retainer casing in designated places so that the retainer casing can be used for a number of different designs of watches. Usually the activator posts and activator buttons are spaced apart by designated arcs subtended at the center of the operating and display module, so that relatively few operating and display modules need to be designated, regardless of the design of the watch case per se. In this manner, manufacture of the operating and display modules can be retained by the electronics industries, and a variety of brands and designs of electronic digital watches may be sold in the retail market, all having identical operating and display modules. In one alternative arrangement, the tabs are also used for orienting, positioning and retaining and components within the watch case.

It is usual to provide at least two activator buttons and activator posts for each electronic digital watch; one to activate the digital display and to determine what function is to be displayed, and the other to provide primary settings of time and date, and for adjustments of the display in the event of short months, movement from one time zone to another by the user, etc.

Yet another embodiment of the retainer casing is provided, as discussed hereafter, whereby the entire casing comprises a pre-formed shell and is formed of an electrically conductive elastomeric material. In this case, the battery and the electronic and display module are secured within the retainer casing shell, such as by the co-operation of an inwardly turned lip when the shell is substantially cup-shaped. The inner end of the activator post is retained in its position by the inherent elasticity of the side of the elastomeric retainer casing, but in such a manner that the inside surface of the side of the retainer casing is not in contact with a respective activator switch element on the electronic and display module. Force exerted axially along the activator post, in the usual manner, causes sufficient deformation of the material of the side of the retainer casing that the inside surface thereof is brought into contact with the activator switch element, thereby closing an electrical circuit from the battery through the electrically conductive elastomeric material to the switch element.

In the preferred embodiment of the elastomeric retainer casing, an additional metal-coated plastic or metallic insert is placed within the shell between the bottom thereof and the underside of the electronic operating module, and the insert is formed with at least one spring tab which is upwardly extending from the insert towards the battery (or at least one such tab for each battery) so as to assure that electrical contact and spring pressure are maintained against the battery.

BRIEF SUMMARY OF THE INVENTION

It is an object of this invention to provide a retainer casing for use in electronic digital watches having non-conductive watch cases, such that all operating circuits of the watch may be activated at will by the user.

A further object of this invention is to provide an electronic digital watch having an electrically non-conductive watch case, a retainer casing therein, and the usual electrical and electronic components, where the styling design of the watch case may be substantially without limit, provided only that the interior of the watch case will accommodate the retainer casing and the electrical and the electronic components required for operation of the watch.

A still further object of this invention is to provide a retainer casing for use with electrically non-conductive watch cases for electronic digital watches, where the retainer casing has sufficient retainer tabs to be adapted to activator posts for electronic digital watches that it may be used with a variety of different types or specific manufacturer's designs of modules.

Yet another object of this invention is to provide a retainer casing for use with electrically non-conductive watch cases for electronic digital watches, where the retainer casing is formed of an electrically conductive elastomeric material and is such that the positioning of the electronic operating and digital display module thereof is easily accommodated; and where the entire assembly may be substantially impervious to the ingress of dust and/or water towards the electronic operating and digital display module.

BRIEF DESCRIPTION OF THE DRAWINGS

These and other features, objects and advantages of the present invention are more fully described hereafter, in the following discussion taken with the accompanying drawings, in which.

DESCRIPTION OF THE PREFERRED EMBODIMENTS

As noted above, an electronic digital watch comprises a plurality of very sophisticated electronic and electrical components; and other operating components which are such that subsidiary electric circuits can be activated at the will and upon the appropriate action by the user in order to control the nature and function of the digital display. For example, many electronic digital watches are provided having an actuator button which provides adjustment of the display in the event that the user travels from one time zone to another, or in the event that there may be fewer than 31 days in a month, or for other circumstances and reasons. Another activator button may be provided which, depending on the length of time or the number of times which it is activated in a given period of time, will control the digital read-out of a function so that such read-out may be the time of day given in hours and minutes, or it may be a running display of the passage of time in seconds, or it may be a read-out of the date given in month and day. In any event, any such electronic digital watch must be such that it has subsidiary electric circuits whose operation is at the control of the user; and therefore momentary make electrical switches must be provided in one form or another.

Figure 1:
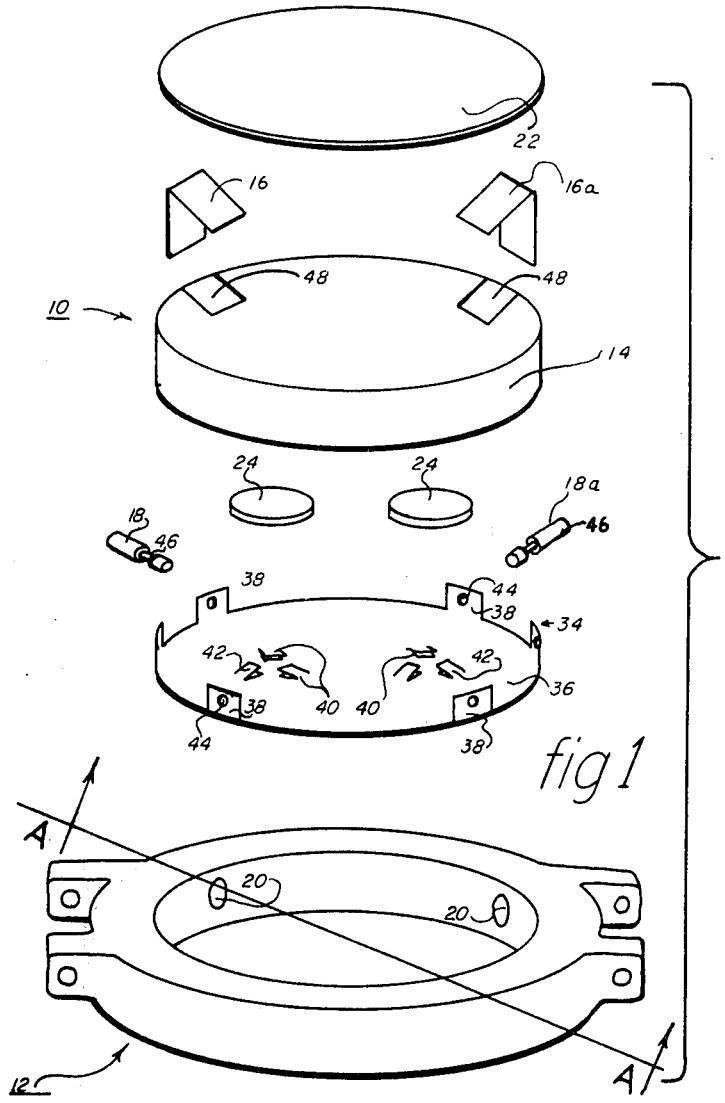
FIG. 1 is an exploded view of the major components of an electronic digital watch assembled according to a first embodiment of the present invention.

The principle components of an electronic digital watch such as that designated by the general reference numeral 10 in FIG. 1, include a watch case generally designated with a reference numeral 12, an electronic operating and digital display module 14, and at least one activator switch element 16. An activator post 18 is provided and extends beyond the periphery of the watch case 12 through a passageway 20, when assembled. A cover or crystal 22 is provided to maintain the interior of the watch case 12 substantially free from dust and moisture. The watch case 12 would normally comprise two pieces or separating halves.

Within a watch case 12 there may be one or more energy cells or batteries 24, which provide the requisite electrical energy at the appropriate voltage for operation of the electronic operating and digital module 14. The precise nature of the module 14 and the batteries 24 are clearly beyond the scope of the present invention, and are irrelevant thereto.

Figure 3:
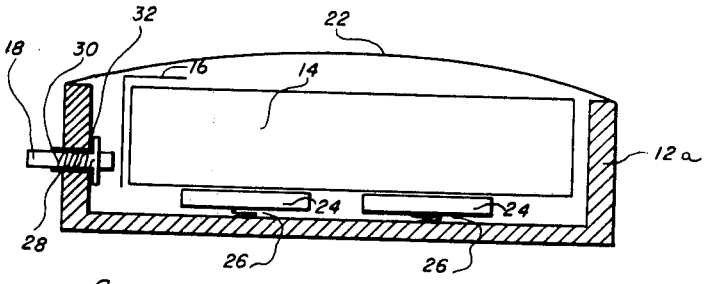
fig 3 (PRIOR ART)
FIG. 3 is a similar cross-section to that of FIG. 2, but of an electronic digital watch according to the prior art.

In the prior art devices, as shown in FIG. 3, which is not intended to be representational but merely illustrative of a typical prior art device, the electronic module 14 sits above batteries 24, which in turn contact springs 26 so as to maintain the batteries 24 in good electrical contact with appropriate areas on the underside of the module 14 and also, through the springs 26, with the metallic watch case 12*a*. The activator post 18 extends through a sleeve 28 and is retained therein by a spring 30 and a collar 32. It will be seen that pressure against the outer end of the activator post 18, beyond a predetermined pressure so as to overcome the spring force of spring 30, brings the inner end of the activator post 18 into contact with the activator switch element 16. Obviously, therefore, an electrical circuit — one of the requisite subsidiary circuits — is established from the battery 24 through the springs 26, the metallic watch case 12*a*, the sleeve 28, the post 18 and the activator switch element 16 to a position of the electronic module 14 that is in contact with the switch element 16 so as to control the function and nature of the digital read-out to be displayed.

When the watch case 12 is to be formed of molded or cast plastics material — such as polyamide, a polyester or other suitable material — obviously no subsidiary electric circuit can be achieved through such plastic watch case. It is necessary, therefore to provide some additional means for effecting the subsidiary operating circuits in the normal operating manner for electronic digital watches.

At the same time, it is desirable to provide easier and simpler means for retaining the activator posts of electronic digital watches, so that assembly time may be reduced as well as the number of components used — with the appropriate economies. To accomplish these ends, the present invention provides a retainer casing designated generally with a reference numeral 34 in FIG. 1, or reference numeral 50 in FIG. 4. Each retainer casing 34 or 50 has a substantially planar bottom 36 or 52 respectively, and a plurality of retainer tabs 38 or 54 respectively which are substantially perpendicularly upstanding from the edge of the respective bottom 36 or 52, and a plurality of spring tabs 40 or 56 which are formed in the respective bottom 36 or 52.

Each of the spring tabs 40 or 56 is upwardly extending from the bottom 36 or 52, and is formed by cutting or stamping three sides of the tab and bending the tab so as to extend upwardly from an opening 42 or 58 which remains. Each of the retainer tabs 38 has a key-hole slot 44 formed therein; and the activator posts 18 or 18a have restricted neck portions 46 formed bear the inner ends thereof. Certain of the tabs 54 are folded as at 60, as discussed in greater detail hereafter; and the activator posts 62 or 62*a* have heads 64 formed at their inner ends.

Each retainer casing 34 or 50 may be stamped or die cut from suitable electrically conductive materials such as a coated plastic material, a heavy foil material, thin spring steel, etc. The material must be such as to have a yield point that the retainer tabs 38 or 54 and spring tabs 40 or 56 may be formed therein and permanently maintained; but the retainer tabs 38 and 54 and the spring tabs 40 and 56 must have resilience and elastic memory in order that they may exert spring force and return — especially in the case of the retainer tabs 38 and 54 — to their original formed position.

Figure 2:
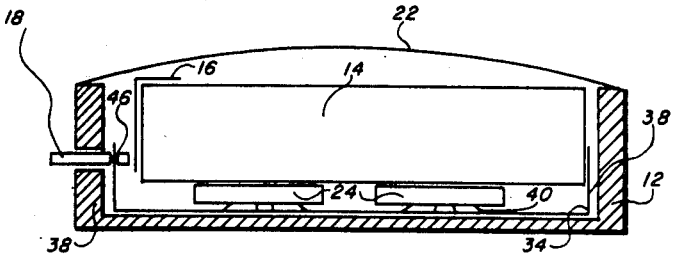
FIG. 2 is a cross-section of an assembled electronic digital watch according to the embodiment of FIG. 1, taken in the direction of arrows A—A in FIG. 1.

Referring briefly to FIG. 2, it will be noted that the electronic module 14 overlies the batteries 24 which, in turn, contact the spring tabs 40. Thus, permanent electrical contact of the upper side of the batteries 24 against the underside of the electronic module 14 is assured. An auxiliary tab or other means may be provided so as to assure the necessary principle electrical operating circuit for continuous energy supply to the electronic module 14. In accordance with this invention, however, it will be noted that pressure above a pre-determined pressure against the outer end of the activator post 18 will cause temporary deformation of the retainer tab 38 within which the restricted neck portion 46 of the post 18 is retained, so that the inner end of the post 18 may contact the activator switch element 16. When such contact is effected, a subsidiary operating electric circuit is provided from the batteries 24 through the bottom portion 36 of the retainer casing 34 to the appropriate retainer tab 38, thence through the activator post 18 to the activator switch element 16, and finally to the appropriate operating portion of the electronic module 14. Because of the resilience and elastic memory of the retainer tab 38, release of pressure against the outer end of the activator post 18 — or an activator button which may be placed over the outer end — will result in contact between the inner end of the activator post 18 and the activator switch element 16 being broken. Thus, the activator post 18 operates in association with the retainer tab 38 and the activator switch element 16 as a momentary make electrical switch; and because the entire circuit operates at extremely low voltages and currents, no difficulties or problems of contactor burning, arcing, etc., will occur. It is, of course, necessary that the retainer casing 34 and the activator post 18 be formed of or coated with sufficiently highly conductive material that no substantial voltage loss occurs in a series resistance that might other wise be formed thereby.

Figure 4:
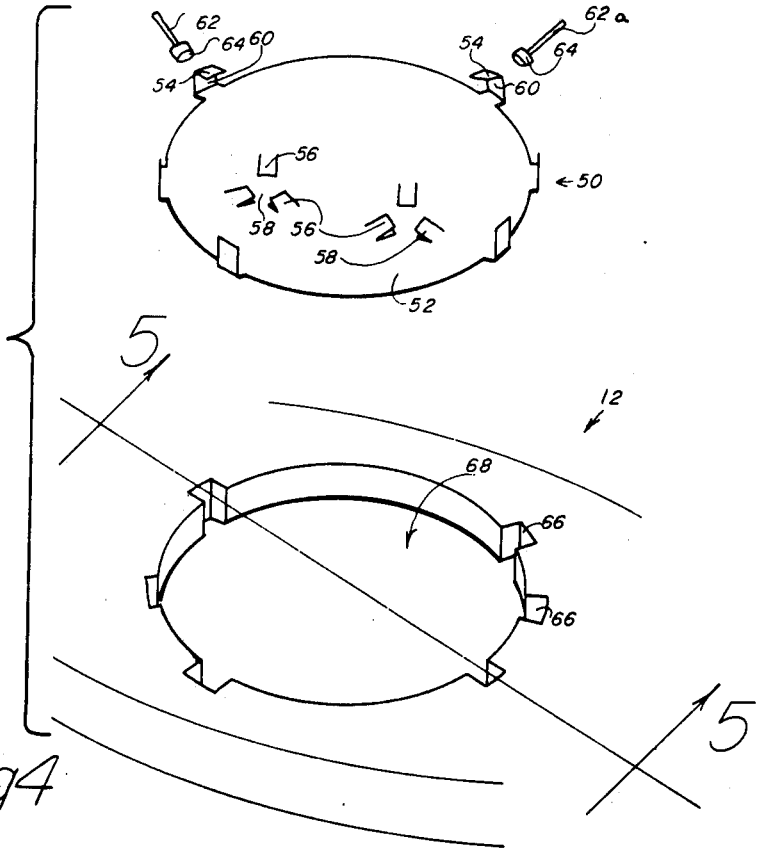
FIG. 4 is a partial exploded view of a second embodiment of the present invention.

It will be noted in FIGS. 1 and 4 that a plurality of retainer tabs 38 and 54 — six, in the preferred embodiments — may be formed around the edge of the retainer casing 34 or 50. However, only two activator posts 18 and 18*a*, or 62 and 62*a*, are shown. The reason for the remaining retainer tabs 38 and 54 is that, depending on the style of the watch, and the manufacture and the design of the operating module, the contactor areas 48 on the electronic module 14 for the activator switch element 16 or 16*a*, or 62 or 62*a*, may be in different places; and sufficient standardization within the industry is now occurring that those places will generally be in six designated locations. Accordingly, six retainer tabs 38 or 54 at the appropriate spacings, are provided. Also, as shown in FIG. 4, the tabs 54 (or 38) may be placed in vertical slots 66 formed in the periphery of the recess 68 of the watch case 12, for purposes of orienting, positioning and retaining the module 14 and the other components in place.

It has also been found that a plurality of spring tabs 40 or 56, arranged somewhat as indicated in FIGS. 1 and 4, may be more acceptable than a single spring tab 40 or 56 for each battery 24, so as to distribute spring force more evenly.

Figure 5:
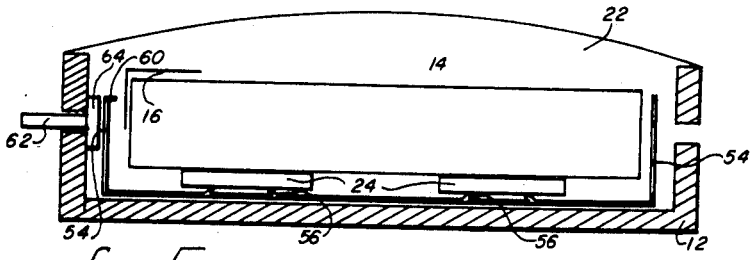
FIG. 5 is a cross-section of an assembled electronic digital watch according to the second embodiment, taken in the direction of arrows 5—5 in FIG. 4.

Referring specifically to FIGS. 4 and 5, it will be noted that two of the tabs 54 — the ones opposite activator posts 62 and 62*a* — are folded over so as to have an inwardly facing tab portion 60. Pressure against the outer end of the respective activator post 62 or 62*a* — 62 in FIG. 5 — will bring the inner end of the tab portion 60 into contact with the activator switch element 16, to close the appropriate subsidiary electric circuit. The resilience of the tab 54 assures that the circuit is broken or discontinued upon release of the pressure against the activator post 62. Thus, the activator posts may be easily formed of a suitable plastics material which nonconductive, with appropriate economies of production and assembly.

As noted above, the third preferred embodiment of the present invention comprises a retainer casing which is a preformed electrically conductive elastomeric shell. Such material may be a carbon-loaded urethane, butyl, silicone rubber or other suitable material; and in any event is cast, molded or heat-formed into a shell in such a manner that the watch components which are assembled into the interior of the case can be assembled into the interior of the shell.

Figure 6:
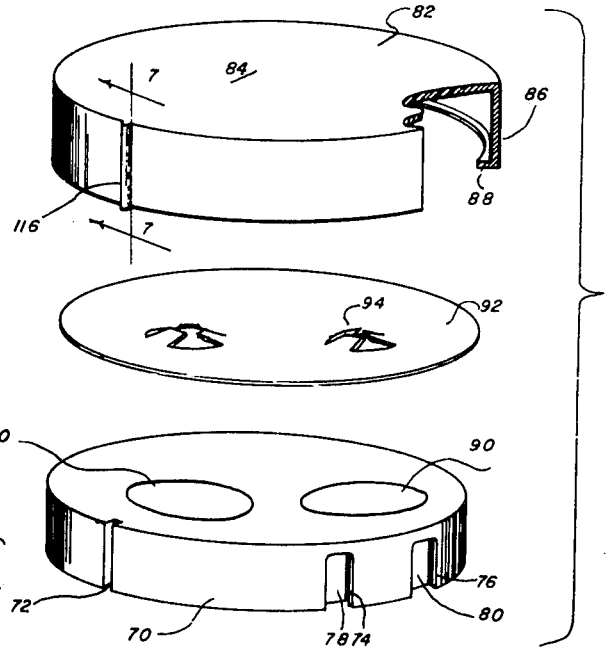
FIG. 6 is a partial exploded view of a third embodiment of the present invention.

Turning to FIG. 6 there is shown an electronic operating and digital display module 70 having an orienting slot 72 formed in its periphery; as well as two recesses 74 and 76 within which are located two activator switch elements 78 and 80, respectively. It will be noted that FIG. 6 is shown upside-down with respect to FIGS. 1 or 4, in that the display side or surface of the module 70 is the underside as it is shown in the drawing. A retainer case 82 is adapted to fit over the electronic operating and digital display module 70; and the retainer casing 82 is formed of an electrically conductive elastomeric material and has a bottom 84, a side 86 and an inwardly turned lip 88 at the extremity of the side wall 86 remote from the bottom 84. The retainer casing 82 is, therefore, substantially cup-shaped.

Located in the underside of the electronic operating and digital display module 70 are one or two cavities within which batteries 90 can be located, for greater security. An insert plate 92 having one or a plurality of tabs 94 upwardly extending therefrom may be interposed between the underside of the electronic operating and digital display module 70 and the bottom 84 of the retainer casing 82, so that the tabs 94 exert spring pressure against the batteries 90 when the module is assembled. It may, however, be possible to assemble the watch components without the insert 92, depending on the relative dimensions and thickness of the batteries 90 and the tension and elasticity of the material of the bottom 84 side walls 86 and rib 88 of the retainer casing 82.

Figure 8:
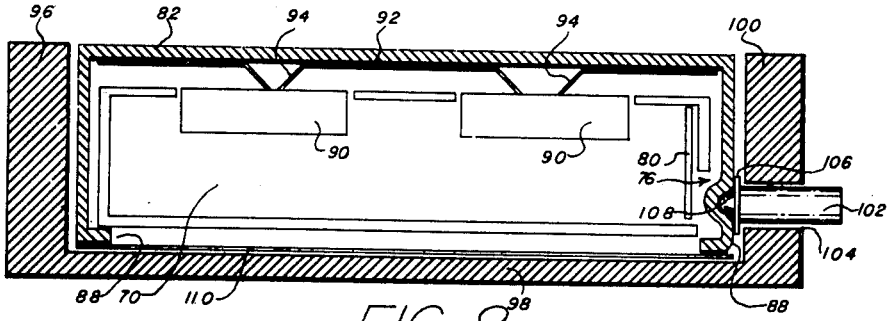
FIGS. 8 and 9 are cross-section views similar to those of FIGS. 2, 3 and 4 but showing the third embodiment in non-actuated and actuated conditions, respectively.
Figure 9:
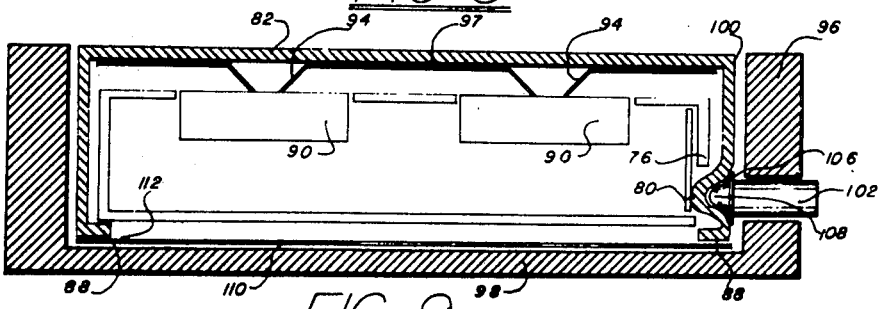

In any event, it will be noted from either of FIGS. 8 or 9 that, when the watch is assembled, the retainer casing 82 having the operating and display module 70 and the batteries 90 assembled thereinto and retained by the inwardly extending lip 88 is, in turn, inserted into a cavity within the watch casing 96. The front face 98 of the watch casing 96 may be of the same material, or another material, and may comprise the crystal of the watch through which the digital display module is viewed or the crystal may be included within the front face 98. In any event, the clearance around the outer periphery of the retainer casing 82, as at 100, may be infinitesimal rather than exaggerated as shown in the figures, so that the assembly of the retainer casing 82 having the components therein into the cavity of the watch case 96 may be substantially a friction fit.

It will be noted that an activator post 102 extends through a suitable passage 104 in the side of the watch case 96. The inner end of the activator post 102 may have a shoulder 106 formed therein, to preclude inadvertent outward movement of the post 102 through passage 104, and a rounded inner end 108. Obviously, the activator posts 102 are inserted in their respective passages 104 before the retainer casing 82 and watch components therein are assembled into the watch case 96. When the assembly is made, however, as shown in FIGS. 8 and 9, it will be noted that there is a slight deformation of the side wall 86 of the retainer casing 82. When the assembly is properly oriented within the watch case — as may be easily accommodated in the manner referred to hereafter — there is a slight protrusion of the deformed side wall of the retainer casing 82 into one of the openings 76 or 78 [for purposes of the drawings, 76 has been chosen] but not so much as to cause any contact between the inner surface of the side wall and the activator switch element 80. However, when more then a pre-determined force is exerted axially along the activator post 102 — the pre-determined force being such as to cause such additional deformation of the wall 86 of the retainer casing 82 as discussed hereafter — the side wall 86 is deformed until contact is made by the inner surface of the side wall 86 of the retainer casing 82 with the activator switch element 76, as shown in FIG. 9. At such time, an electrical circuit is established from battery 90 to the activator switch element 80 through the retainer casing 82 (and the insert 92 when used) and the required digital display which had been chosen by the user is displayed in the appropriate manner. Upon release of the activator post 102, that is when the force acting axially therealong is removed, the elastic memory of the elastomeric material is such as to cause the activator post 102 to move outwardly through passage 104 and to cause the inner surface of the side wall 86 of the retainer casing 82 to move out of contact with the respective switch element 78 or 80. Thus, a momentary make switch has been achieved, with the break operation of that switch being realized whenever force is released from acting axially along the activator post 102 towards the respective activator switch element 78 or 80.

It has been noted that, in general, the fit between the exterior of the retainer casing 82 and the interior of the cavity formed in the watch case 96 is a friction or squeeze fit. Thus, ingress of water or dust along the periphery 100 of the retainer casing 82 is substantially precluded. However, so as to provide even greater protection against the ingress of dust or water towards the electronic operating and display module 70, an optically clear mask 110 may be provided over the display face of the module 70; and the mask 110 may be secured in place by a suitable adhesive 112 on the outer face of the inwardly turned lip 88 of the retainer casing 82.

Figure 7:
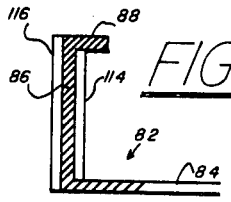
FIG. 7 is a partial cross-section taken in the direction of arrows 7—7 in FIG. 6.

In addition, it is a feature of the retainer casing 82 that very easy orientation of the digital display module with respect to the watch case 96 can be achieved by the co-operative relationship between a pair of orienting ridges and their respective orienting slots. Thus, FIG. 7 shows a cross-section through the side wall 86 of the retainer casing 82; and is shown in an inverted position relative to the retainer casing which is shown in FIG. 6. In any event, there is shown on the inside of the retainer casing 82, formed against the inside surface of the side wall 86, an inwardly extending ridge 114 which, for ease of forming, extends between the bottom 84 and the inwardly extending lip 88. That inwardly extending orienting ridge 114 co-operates with the orienting slot 72 formed in the outer periphery of the electronic operating and digital display module 70, so as to orient or position the digital display in a given position relative to the orienting ridge 114. A further orienting ridge 116 is formed on the exterior surface of the side wall 86 of the retainer casing 82; and may be opposite the ridge 114 or in an entirely different place. In any event, the exterior orienting ridge 116 co-operates wih a slot such as one of the slots 66 shown in the watch case of FIG. 4, so as to orient or position the retainer casing 82 and thereby the digital display module with respect to the watch case 96. It is thereby very simple to assemble the retainer casing 82 together with the electronic operating and digital display module 70 and batteries 90 into a watch case 96 and to be sure that the openings 78 and 80 are properly oriented with respect to activator posts 102 and that the digital display is properly oriented with respect to the watch case.

It should also be noted that in an electronic digital watch according to any embodiment or alternative arrangement of this invention, the operation of the watch assembly can be tested and observed without the necessity of placing the watch case in position. Thus, workshop or laboratory tests and repairs may be easily effected.

There has been described several alternative embodiments of an electronic digital watch having a low priced plastics watch case which, however, is electrically non-conductive; and in which an electrically conductive retainer casing is provided to maintain the batteries, the activator posts and the other components in their designated positions and so that subsidiary electric circuits can be activated at will by the user. Any suitable materials can be used, and amendments and substitutions made without departing from the spirit and scope of the appended claims.

The embodiments of the invention in which an exclusive property or privilege is claimed are defined as follows:

1. For an electronic digital watch having a watch case; at least one battery, an electronic operating and digital display module and an activator switch element associated with said display module contained in said watch case; and at least one activator post entending beyond the periphery of said watch case and into the interior thereof, and adapted to cause a closing action of said activator switch element so as to provide an electrical circuit through said element only when said activator post has at least a pre-determined force exerted axially therealong; the improvement where:

said watch case is substantially electrically non-conductive; and said watch case further contains an electrically conductive retainer casing having a substantially planar bottom, said retainer casing being a pre-formed shell of elastomeric material, and being adapted to contact and to exert and maintain spring pressure against a first side of at least one battery remote from said digital display module;

said retainer casing having a side upstanding from said bottom and an inwardly turned lip to co-operate with said electronic and digital display module to secure the same therein; and being adapted to retain the inner end of said activator post out of a co-operating position with respect to said activator switch element which would result in said closing action of said switch element, except when at least a pre-determined force is extended axially along said activator post;

so that when at least said pre-determined force is exerted axially along said activator post, the inner end of said activator post is forced to act against the elastic memory of a portion of the side of said retainer casing shell so as to move it into contact with said activator switch element, so that an electrical circuit from said first side of said battery to said switch element is formed and includes said retainer casing shell; and when said axial force is released, the elastic memory of said portion of the side of said retainer casing shell causes said activator post to move away from said activator switch element.

2. The combination of claim 1 where a substantially planar, electrically conductive insert is secured in said shell between the bottom thereof and the botom of said electronic module, and has at least one upwardly extending spring tab formed therein and adapted to contact and maintain spring pressure against said first side of said battery.

3. The combination of claim 2 where a first orienting ridge is formed on the inside surface of the side of said shell to co-operate with an orienting slot formed in the outer periphery of said electronic operating and digital display module, and a second orienting ridge is formed on the outside surface of the side of said shell to co-operate with an orienting slot formed in the interior surface of said watch case; so that said digital display module is properly oriented in said watch case when said first and second orienting ridges and their respective orienting slots are each in co-operating relationship.

* * * * *